United States Patent [19]

LeRoy et al.

[11] Patent Number: 5,031,289

[45] Date of Patent: Jul. 16, 1991

[54] TRANSFER DEVICE AND COMPRESSION AND INTRODUCTION DEVICE FOR TUFTING MACHINE

[75] Inventors: Guy LeRoy, Elancourt; Pierre Asselin, Elbeuf, both of France

[73] Assignee: Etablissements Asselin, Elbeuf, France

[21] Appl. No.: 415,315

[22] PCT Filed: Oct. 7, 1988

[86] PCT No.: PCT/FR88/00498

§ 371 Date: Jul. 14, 1989

§ 102(e) Date: Jul. 14, 1989

[87] PCT Pub. No.: WO89/03446

PCT Pub. Date: Apr. 20, 1989

[30] Foreign Application Priority Data

Oct. 9, 1987 [FR] France ..... 8713977

[51] Int. Cl.[5] ..... D04H 18/00

[52] U.S. Cl. ..... 28/107; 28/214

[58] Field of Search ..... 28/214; 112/80.3, 80.32; 198/814

[56] References Cited

U.S. PATENT DOCUMENTS 2,809,600 10/1957 Robb et al. ..... 112/80.3
4,185,738 1/1980 Tsukumo ..... 198/814

FOREIGN PATENT DOCUMENTS 2180928 11/1973 France .
2265896 10/1975 France .
2393095 12/1978 France .
1062590 3/1967 United Kingdom ..... 112/80.3

*Primary Examiner*—Werner H. Schroeder
*Assistant Examiner*—John J. Calvert
*Attorney, Agent, or Firm*—Young & Thompson

[57] ABSTRACT

The device carries a bundle of fibers between an upper and lower table of a tufting machine. The bundle of fibers is transferred to a tufting machine by a transfer device having a pair of roller driven conveyors. The conveyors are individual drive belts having individual adjustability over the width of the transfer device. Individual tension is provided in each longitudinal region of the width permitting suitable guiding of each belt despite the very short developed length. The transfer device provides for positively driving the fiber bundle toward the interior of the tufting passage.

30 Claims, 4 Drawing Sheets

TRANSFER DEVICE FOR COMPRESSION AND INTRODUCTION DEVICE FOR TUFTING MACHINE

The present invention relates to a transfer device for the inlet of a tufting machine.

The present invention also concerns, for a tufting machine, a compression and introduction device which comprises such transfer devices.

To compress and introduce a bundle of fibers entering a tufting machine, the bundle is made to pass between two rollers. To limit on the one hand the re-expansion of the bundle and on the other hand the loss of part of the fibers, the run from the rollers to the tufting passage of the tufting machine extends between two rows of oblique flexible teeth.

It will readily be seen that the compression and introduction device only imperfectly fulfills it roll. The fibers are not positively conducted into the tufting passage. They arrive there after having partially re-expanded. The fibers tend to escape between the outlet of the rollers and the inlet of the tufting passage.

The object of the invention is to provide a transfer device, as well as an apparatus for compression and introduction, which overcomes these drawbacks.

According to the invention, the transfer device adapted to form a portion of a device for compression and introduction to the inlet of a tufting machine and comprising a roller is characterized in that it comprises flexible endless transport means having a transport run between one upstream end of the flexible transport means about the roller and a downstream end at which the flexible transport means passes about at least one nose, differential spacing means being provided to adjust to different values according to different points on the width of the device the distance between the axis of the roller and the downstream end of the transport run.

Thus, the flexible transport means can positively drive the bundle for a certain distance. The downstream end of the transport run may be very close to the inlet to the tufting passage. Thus, at this end, the transport means passes about noses, which permits it to deliver the transported product with great precision.

The differential spacing means overcome the problems habitually attending conveyor belts whose developed length is small relative to the width.

The invention resides in the surprising realization that it is possible to guide suitably a belt of relatively short length relative to its width by varying the distance between the axis of the roller and the downstream end of the transport run, and this in a differential manner at different points along the width of the flexible means.

This manner of stabilizing the flexible means is based on the assumption that the variations in positioning of the flexible means whose width is greater than its length are due to the variations in the developed length at different points across the width of the belt. This supposition leads one to seek to stabilize the belt laterally by compensation of said variations for example by equalizing the tensions at different points along the width, and/or by the deliberate creation of conditions of suitable variation with a view to displacing laterally the flexible means in the direction contrary to that of an error ascertained in the lateral position of the belt.

According to a second aspect of the invention, the compression and introduction device for a tufting machine comprises two transfer devices of the type described above, mounted such that their transport runs face each other.

Other features and advantages of the invention will become apparent from the following description:

In the accompanying drawings, given by way of non-limiting examples:

Figure 1:
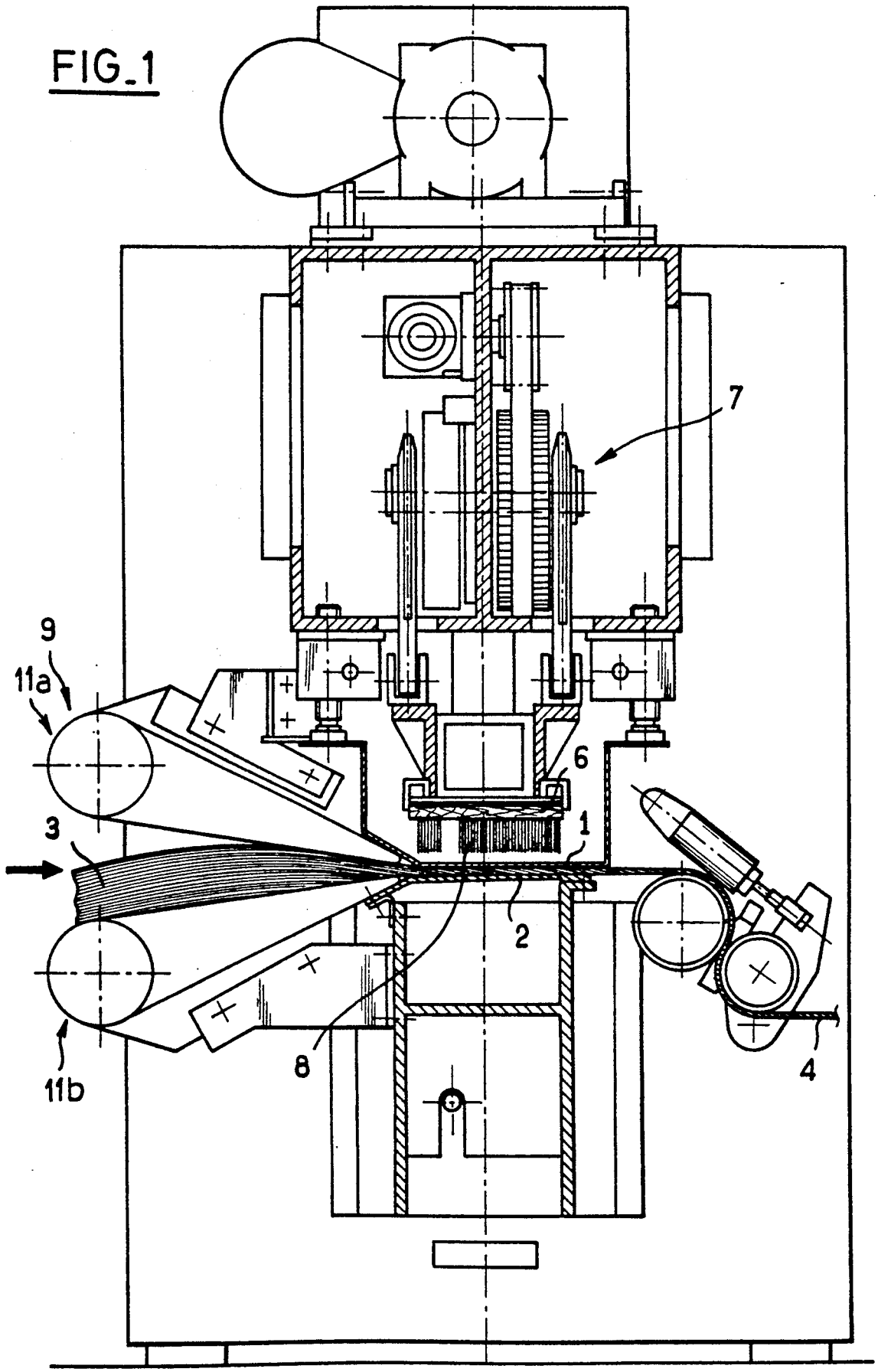
FIG. 1 is an elevational and longitudinal cross-sectional view of a tufting machine provided with a compression and introduction device according to the invention.

As is shown in FIG. 1, a tufting machine comprises an upper table 1 and a lower table 2 defining between them a substantially horizontal tufting passage through which is advanced a product 3 which, entering in the form of a bundle comprised of fibers with little or no connection between them, leaves in the form of a tufted carpet 4. A needle plate 6 is connected to a mechanism 7 for reciprocatory displacement such that needles 8 carried by plate 6 enter the tufting passage through appropriate openings in table 1, and leave from this passage, with a predetermined frequency. In known manner, this causes the fibers of the bundle to intersect and confers cohesion and mechanical strength on the resulting carpet.

Upstream of the tufting passage, the machine comprises a compression and introduction device 9 whose function is to precompress the bundle 3 while moving it with the least possible loss to the interior of the tufting passage.

Figure 2:
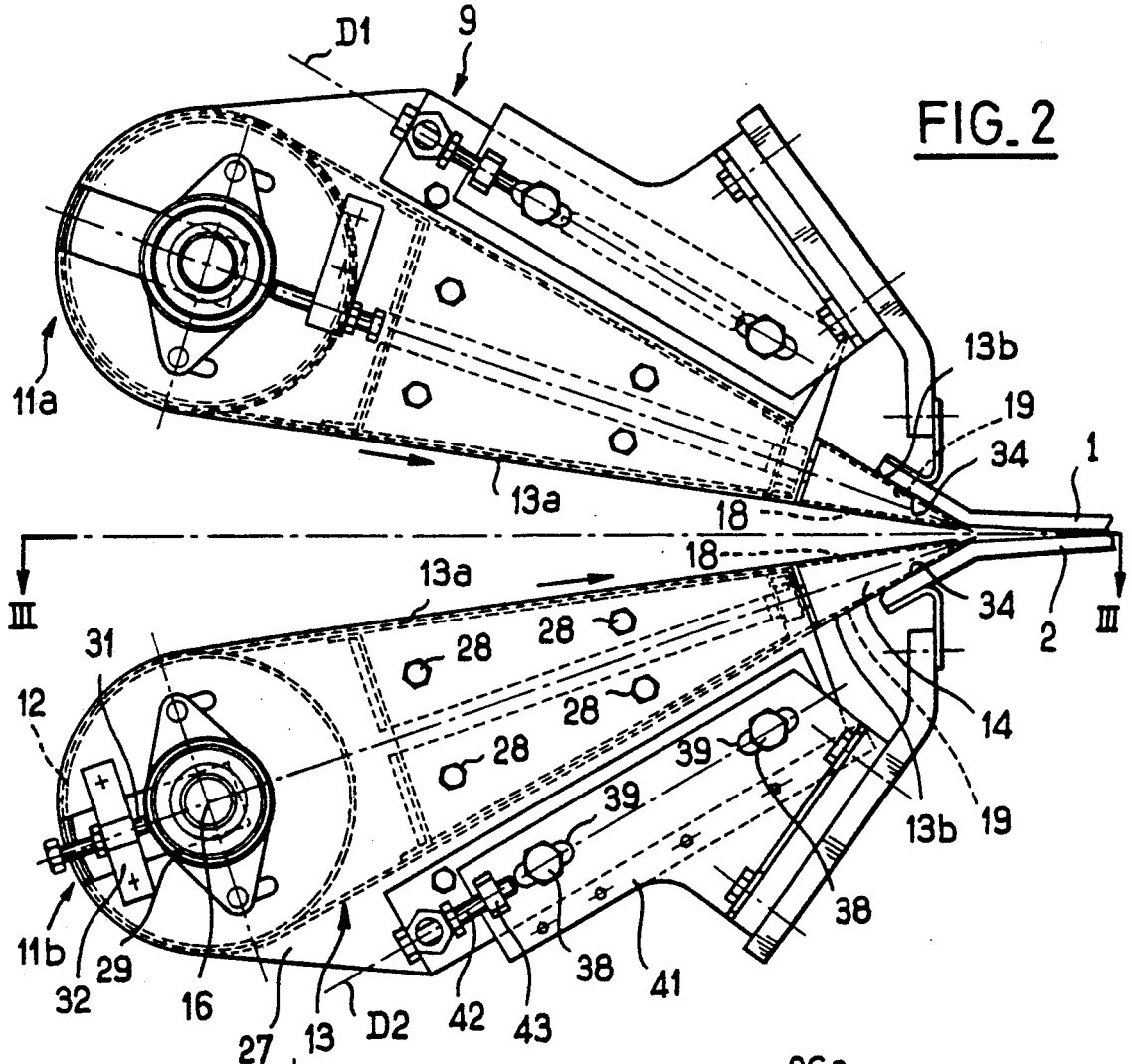
FIG. 2 is a side elevational view, on an enlarged scale, of the compression and introduction device of the tufting machine of FIG. 1.

As is shown in FIG. 2, the compression and introduction device 9 comprises an upper transfer device **11*a* and a lower transfer device 11*b* which are substantially identical. There will be described hereafter the transfer device 11*b***.

The transfer device **11*b* comprises a roller 12 disposed at the upstream end of the device. According to the invention, the roller 12 drives in rotation a flexible endless conveyor means 13**, in the case of a carpet extending the full working width of the tufting machine. The belt is of polyester cloth coated with polyvinyl chloride or polyurethane. The belt will have a single thickness of fabric. The total thickness of the belt is less than 1 mm.

The belt 13 has a transport run **13*a* extending between an upstream end in which it turns about the roller 12, and a downstream end in which it turns about a row of noses 14 aligned in a direction substantially parallel to the axis 16 of the roller 12**.

Figure 3:
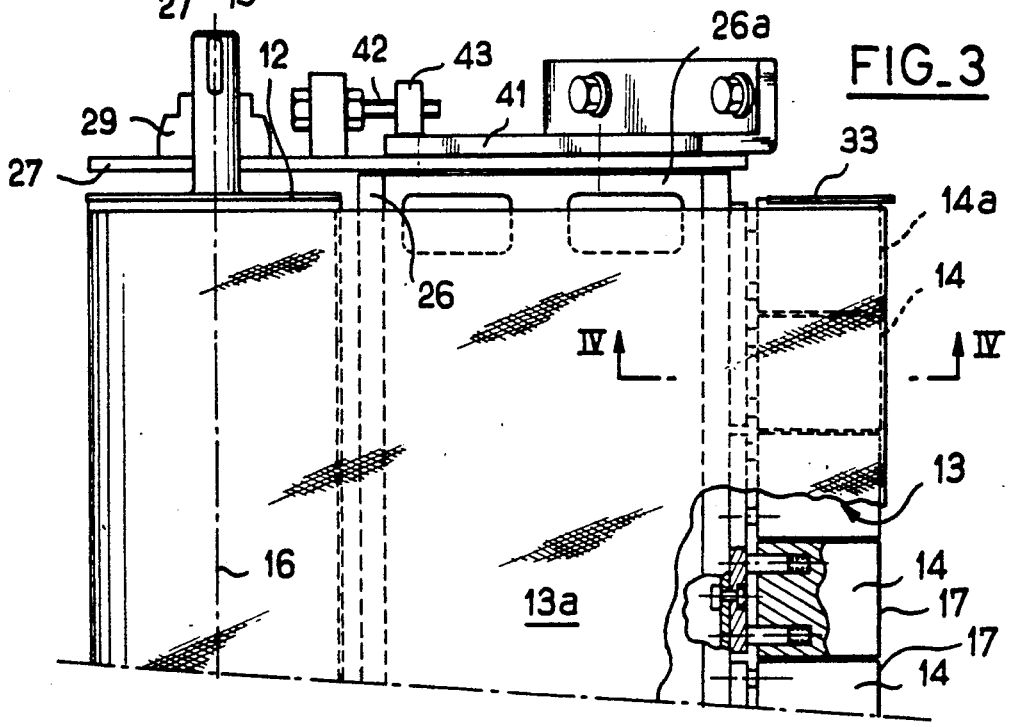
FIG. 3 is a fragmentary view of the compression and introduction device on the line III—III of FIG. 2.

The noses 14 are also to be seen in FIG. 3. Each nose 14 has the general shape of a prism whose lateral surfaces are parallel to the axis 16 of roller 12. The base surfaces of each prism are adjacent the base surfaces of the neighboring prisms. The size of each nose 14, measured parallel to the axis 16, is of the order for example of 100 mm. In the example, each nose 14 has a width of 98 mm, the distance between the noses being 2 mm.

The belt 13 passes about the edge 17 of each nose 14 which is opposite the roller 12. The edge 17 is cylindrically rounded off. Its radius of curvature r (FIG. 5) is for example 4 mm.

The edge 17 is adjacent two flat surfaces 18 and 19 on which the belt 13 bears along its transport run 13a and respectively along its return run **13*b* toward roller 12. The surfaces 18 and 19 converge toward edge 17** at an angle which is of the order of 25°.

Figure 4:
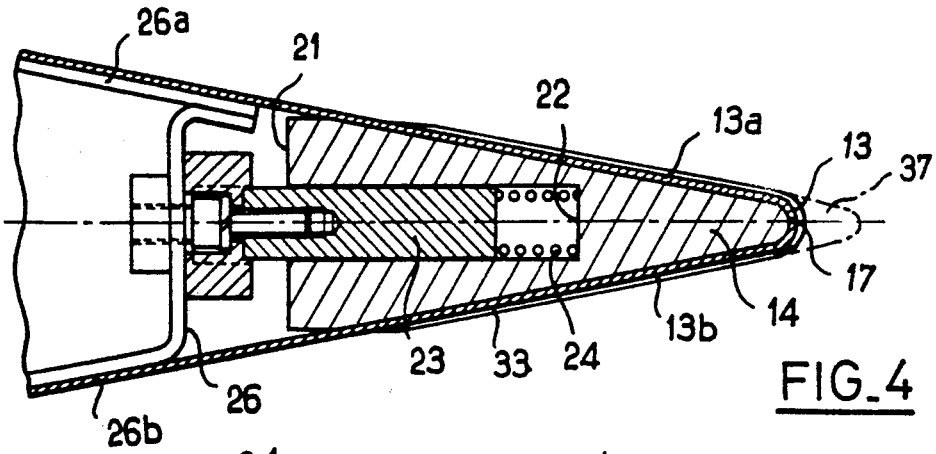
FIG. 4 is a cross-sectional view on the line IV—IV of FIG. 3 on an enlarged scale.

As shown in FIGS. 3 and 4, the noses 14 are independently urged relative to each other in a direction opposite the roller 12. For this, each nose 14 has on its rear surface 21, opposite the edge 17, two parallel recesses 22 in which are slidably engaged plungers 23. A coil compression spring 24 is disposed between the bottom of the recess 22 and the free end of the associated plunger 23, so as to urge the nose 14 in a direction away from roller 12, as stated.

The plungers 23, all cylindrical, parallel to each other, and aligned in a plane passing through the axis of roller 12 and through edge 17, are rigidly carried by a support 26 disposed between the roller 12 and the noses 14 and between the transport and return runs **13*a* and 13*b* of the belt 13. The support 26 comprises two opposite surfaces 26*a* and 26*b* slidably supporting the belt 13 along its respective transport and return runs 13*a* and 13*b***.

The transfer device **11*b* also comprises two lateral support plates 27 located on opposite sides of belt 13 and to which the support 26 is secured by screws 28 (FIG. 2). Each end plate 27 also supports one of the bearings 29 of the roller 12 with the possibility of sliding in the oblique plane passing through the roller axis and through the edge 17 of the noses 14, 14*a*. By said sliding, the bearings 29 bear against a screw 31 for adjusting the tension of the belt 13. The screw 31 is screwed into an ear 32 fixed to the respective plate 27. The screw 31 of the upper roller pushes the upper roller away from the noses 14, against the weight of the roller. By contrast, the lower screw 31 compresses the lower roller toward the noses 14** because the resultant force of the weight of the roller exceeds the desired tension in the belt.

As shown in FIG. 3, each end nose **14*a* has on its edge opposite the other noses a guide flange 33 for the belt 13**.

Figure 5:
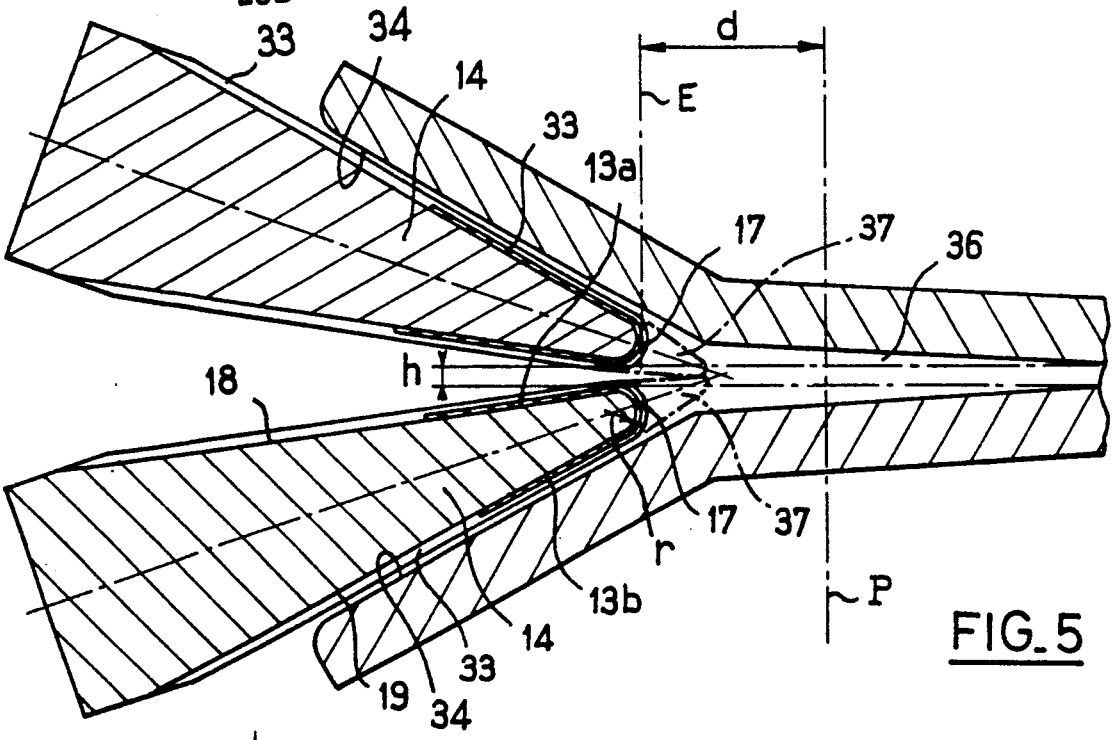
FIG. 5 is a view of a detail of the compression and introduction device on a still larger scale, on the line IV—IV of FIG. 3.

As shown in FIGS. 2 and 5, the transfer devices **11*a* and 11*b* are disposed one above the other with the transport runs 13*a* of their respective belt 13 located facing each other. Thus, the transport run 13*a* of the upper device 11*a* corresponds to the lower run of the associated belt 13, and the transport run 13*a* of the lower transfer device 11*b* corresponds to the upper run of the associated belt 13**.

Moreover, the transport runs **13*a* of the two belts converge from rollers 12 toward noses 14. For example, the distance between th runs 13*a*may be from 120 to 180 mm at the rollers 12, and diminish to about 4 mm in the narrowest region adjacent the edges 17**.

The upper and lower tables 1 and 2 of the tufting machine are bent adjacent the edges 17 so as to define between them an introduction slot having a V-shaped opening toward the rollers 12. The interior oblique surfaces 34 of this slot are adjacent the return runs **13*b* of the belts 13, in the region adjacent the surfaces 19 of the noses 14. Thus, each belt 13 extends to the immediate vicinity of the beginning of the tufting passage 36 (FIG. 5). The distance d between the plane E of the ends of the runs of the belt 13 and the vertical plane P of the first needles of the needle plate 6 is for example about 25 mm. The tufting passage 36** has itself a width which diminishes for example from 10 mm to 4 mm from the inlet to the outlet.

As shown in FIG. 2, the position of each transfer device **11*a* or 11*b* is adjustable by displacement of bolts 38 connected to the plates 27 in slots 39 formed in supports 41 secured to the frame of the tufting machine. Each plate 27 carries rotatably a screw 42 adjustably screwable into an ear 43 of the support 41 so arranged as to adjust the position of the bolts 38 in the slots 39. The direction D1 of said adjustment for the transfer device 11*a*, and the direction D2 of this adjustment for the device 11*b* converge from the rollers 12 toward the noses 14 and are more particularly parallel each to the associated surface 34 of the V-shaped introduction slot. Thus, by adjustment of screws 42, the devices 11*a* and 11*b* can be made to slide parallel to the surfaces 34 of the introduction slot so as to increase or reduce as desired the minimum distance h between the runs 13*a* of the two belts 13**.

In operation, the two belts 13 circulate in opposite directions, so that the two transport runs **13*a* will have a direction of movement from the rollers 12 toward the noses 14. The fiber bundle arriving at the tufting machine is thus compressed at the same time that it is driven toward the introduction slot of the tufting passage. Thanks to the invention, the losses of fibers are substantially none because the transfer devices 11*a* and 11*b*** convey the fibers substantially to the interior of the tufting passage.

In known manner, the tufting machines have working widths that can be from 2.50 m to 6 m. The belts 13 therefore have a width, measured parallel to the axis 16 of the rollers 12, which is from 2.50 m to 6 m as needed. The developed length of each belt 13 is less than its width. For example, said developed length is 1.60 m. In spite of this very unfavorable ratio of dimensions for good guidance of an endless belt, the individual noses 14 according to the invention, which stretch the belt in each of its longitudinal regions, ensure that the belt will have only a slight tendency to slide laterally, a tendency which nevertheless is characteristic of belts with a developed length very short relative to their width.

Thus, the individually urged noses provided by the invention resolve both the problem of guiding a short belt and the problem of the precise introduction of a material of low mechanical strength.

Figure 6:
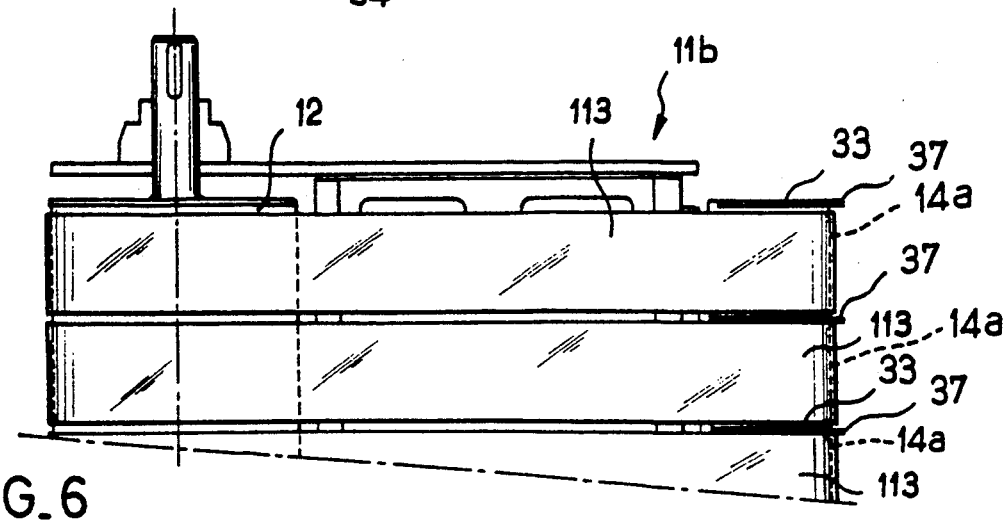
FIG. 6 is a view similar to FIG. 3, but of another embodiment of the invention.

According to a modified embodiment shown in FIG. 6, the single belt of each transfer device **11*a* or 11*b* is replaced by drive belts 113 of which each passes about the roller 12 and the respective one of the noses 14. These latter are all noses 14*a*, each comprising a flange 33. Moreover, as shown in mixed lines in FIGS. 4 and 5, each flange 33 is prolonged by a finger 37** extending beyond the plane E, to contribute to the guidance of the bundle of fibers in the direction of movement over the short path from the plane E to the beginning of the tufting passage.

Each drive belt 113 has a width which is slightly less than that of the noses **14*a*, such that the width of the intervals adjacent drive belts 113** is small.

Otherwise, the tufting machine according to FIG. 6 is identical to that of FIGS. 1 to 5.

According to this embodiment, each drive belt 113 has a relatively small width relative to its developed length, which avoids the difficulties of guidance. However, the loss of fibers, particularly through the gaps between the guide belts 113, are less effectively prevented than in the embodiment of FIGS. 1 to 5.

Figure 7:
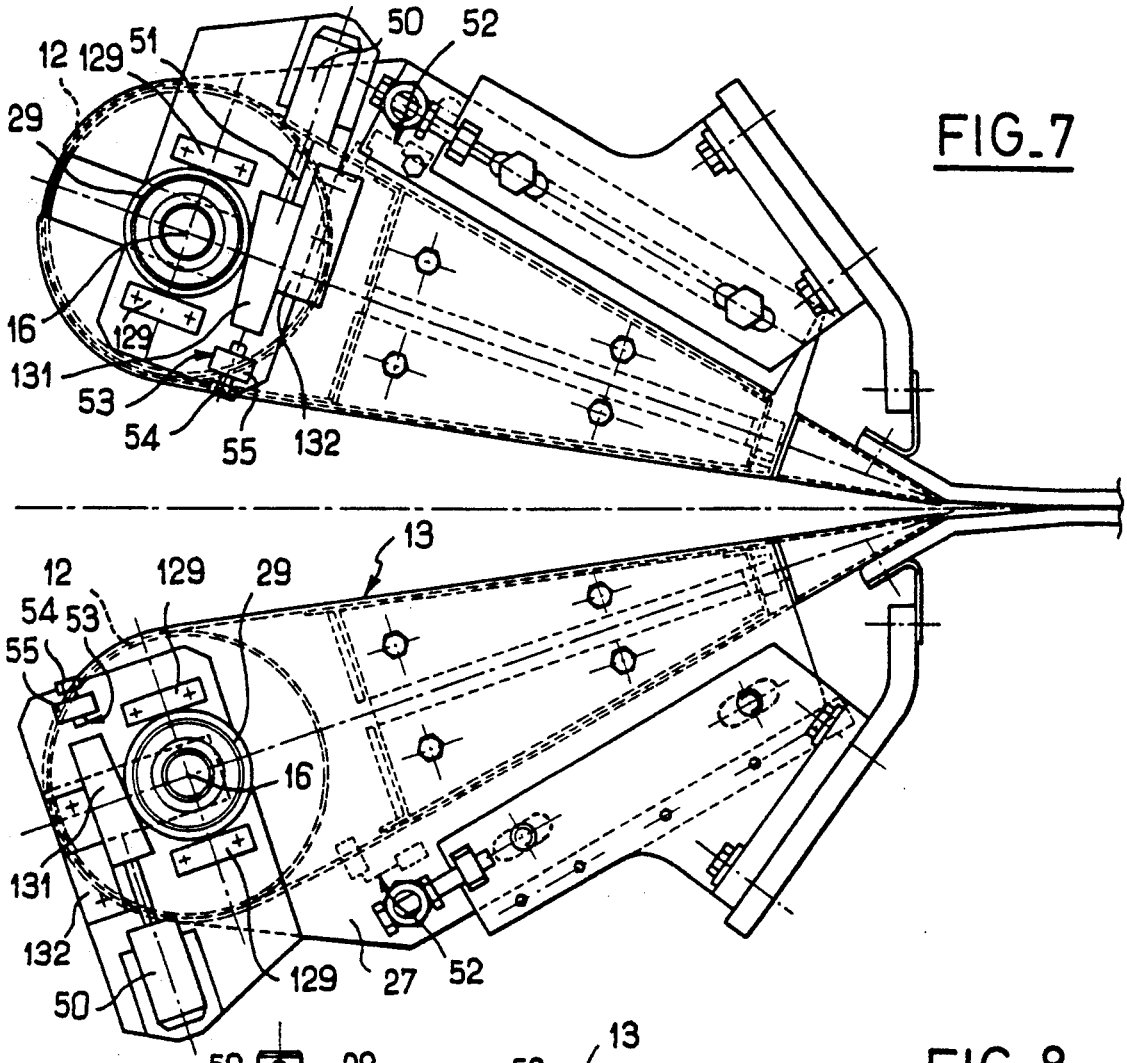
FIG. 7 is a view similar to FIG. 2, but of another embodiment of the invention.
Figure 8:
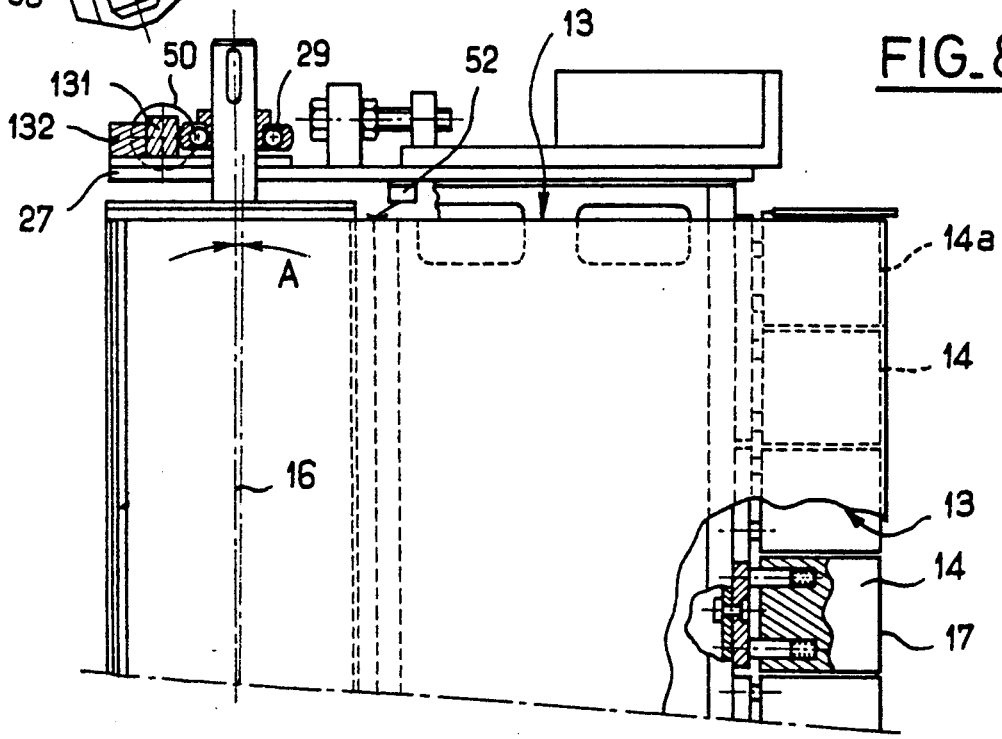
FIG. 8 is a view similar to FIG. 3, but relating to the embodiment of FIG. 7.

According to another embodiment shown in FIGS. 7 and 8 and particularly adapted to devices of very great width, one of the bearings 29 of the roller 12 of each transfer device bears against a set screw 31 as described above. The other bearing 29 is disposed between two guides 129 between which it can slide in a plane passing through the end line of the noses. This sliding is limited by a pusher in the form of a wedge 131 movable perpendicularly to the said plane, and engaged between said bearing 29 and an ear 132 forming an abutment fixed to the corresponding plate 27. The position of the pusher in the form of a wedge 131 is permanently adjustable by a double acting jack 50, for example pneumatic, whose position of the rod 51 is controlled by a regulator, known per se and not shown, as a function of the indications given by two feelers 52, known per se, disposed respectively on opposite sides of the belt 13. An adjustable abutment 53, constituted in the illustrated example by a screw 54 screwed in an ear 55 secured to the plate 27, permits limiting the displacement of the wedge 131 as a function of the reaction capacity of the belt. Thus, the jack 50 permits adjusting the angle of inclination A between the axis of the roller in the plane passing through the axis of the roller and through the row of noses. Such an angle is permitted by the bearings 29, which are roller bearings. In the drawings, the pushers 131 are shown in a mean position, for purposes of illustration, but in practice it is preferred that the pusher 131 will always be in one or the other of its end positions, namely that corresponding to the feeler 52 which has been actuated in the last instance by the belt (all or nothing regulation). The path of the associated bearing 29 is for example about 5 mm long. This path varies the compression of the springs 24 (FIG. 4), and as a result the tension in the belt, in a manner which is unequal along the width of the belt.

As shown in FIG. 7, in the upper transfer device in which the tension of belt 13 and the weight of the roller 12 exert on the latter forces which both tend to bring the roller 12 and the noses 14 together, the abutment 132 is disposed between the bearing 29 and the noses, and the wedge 131 is introduced between said bearing 29 and the abutment 132.

By contrast, in the lower transfer device, the weight of the roller 12 acts in the direction opposite to that of the tension in the belt 13. The abutment 132 is situated relative to the bearing 29 on the side opposite the noses 14, the wedge 131 being introduced between said bearing and said abutment, so as to limit the belt tension to a value less than that which corresponds to the free action of the weight of the roller (12) on the belt.

The manner of operation of this assembly of abutment 132 and wedge 131 actuated by jack 50 is as follows. The feeler 52 which detects a displacement toward itself of the belt 13 so notifies the regulator which acts such that the tension of the belt 13 will be higher at the end of the roller 12 located on the side of the actuated feeler 52 than on the other side. Stated otherwise, if the actuated feeler is the one located on the same side of the belt 13 as the jack 50 and the wedge 131, the regulator controls said displacement of the wedge which increases the distance between the corresponding bearing 29 and the noses 14, which increases the tension of the belt 13 on this same side.

If on the other hand the actuated feeler is located on the other side of the belt 13 relative to the wedge 131, the regulator controls a displacement of the wedge which causes the corresponding bearing 29 to approach the noses 14, which has the effect of decreasing the tension of belt 13 on the side of this bearing to render it less than that on the side of the other bearing. In these two cases, the belt 13 displaces laterally toward the corresponding bearing 29 of lesser tension.

This system effectively cooperates with the noses 14 to ensure satisfactory guiding of the belt 13, more particularly for very great width of this latter.

Of course, the invention is not limited to the described and illustrated examples.

In particular, the noses could be constituted by all manner of elements guiding the flexible transport means according to a very small angle of curvature. It could for example be cylindrical fixed or rotatable rods, whose radius corresponds to said radius of curvature.

Similarly, the jack 50 could be a hydraulic jack, and the assembly constituted by jack 50, wedge 131 and abutment 132 and adapted to adjust the distance of one of the bearings 29 of the roller 12 relative to the line of noses 14 could be replaced by an eccentric device.

The row of noses 14, 14*a* could be replaced by a single nose extending over the entire width of the belt and rigidly fixed to the support such as 26, while the belt could bear along its return run on a row of rollers resiliently urged independently of each other so as to equalize the tension at different points along the width of the belt.

We claim:

1. A transfer device for conveying fibers into a tufting machine, the transfer device (11*a*, 11*b*) comprising a roller (12) having an axle (16), flexible endless conveyor means (113) having a transport run (13*a*) extending between an upstream end at which the flexible conveyor means passes about the roller (12), and a downstream end, a row of noses (14*a*) aligned along said downstream end defining a width, the flexible conveyor means passing about said row of noses, and differential spacer means to adjust to different values a distance between the axle of the roller at different points along the width of the device and the downstream end of the transport run, said differential spacer means comprising stretching means to urge the noses independently of each other in a direction away from the roller, wherein the flexible conveyor means comprises individual drive belts (113) turning about each of the noses (14*a*).

2. A device according to claim 1, further comprising flanges (33) for guiding the flexible conveyor means (113) about the noses.

3. A device according to claim 2, wherein each flange (33) is extended beyond the transport run (13*a*) of the flexible conveyor means for guiding transported fibers (3) beyond the transport run (13*a*).

4. A device according to claim 1, wherein said differential spacer means further comprise means automatically to adjust the position of the axle (16) of the roller (12) in a plane passing through the downstream end of the transport run.

5. A device according to claim 4, wherein said means (50, 131, 132) automatically to adjust the position of the axle (16) comprises a wedge (11) between a bearing (29) of the roller (12) and a fixed abutment (132), and means

(50) selectively to modify the position of the wedge (131) between the bearing (29) and the abutment (132).

6. A device according to claim 1, wherein at least part of the differential spacer means is controlled at least indirectly by means (52) for detecting the lateral position of the flexible endless conveyor means (13, 113) on the roller (12).

7. A transfer device for conveying fibers into a tufting machine, the transfer device (11*a*, 11*b*) comprising a roller (12) having an axle (16), flexible endless conveyor means (13) having a transport run (13*a*) extending between an upstream end at which the flexible conveyor means passes about the roller (12), and a downstream end, a row of noses (14, 14*a*) aligned along said downstream end defining a width the flexible conveyor means passing about said row of noses, and differential spacer means to adjust to different values a distance between the axle of the roller at different points along the width of the device and the downstream end of the transport run, said differential spacer means comprising stretching means to urge the noses independently of each other in a direction away from the roller, wherein the flexible conveyor means is a belt (13) turning about the assembly of noses (14).

8. A device according to claim 7, further comprising flanges (33) for guiding the flexible conveyor means (13) about the noses.

9. A device according to claim 8, wherein each flange (33) is extended beyond the transport run of the flexible conveyor means for guiding transported fibers (3) beyond the transport run (13*a*).

10. A device according to claim 7, further comprising a support (26) mounted between the noses (14, 14*a*) and the roller (12), and supporting each nose by means of two plunger devices (23) urged by a spring (24).

11. A device according to claim 10, wherein the support has two opposite surfaces (26*a*, 26*b*) on which the flexible conveyor means (13) is slidably mounted along the length of its transport run (13*a*) and respectively the length of a return run (13*b*).

12. A device according to claim 7, comprising a stationary support having two opposite surfaces (26*a*, 26*b*) on which the flexible conveyor means (13) is slidably mounted along the length of its transport run (13*a*) and respectively the length of a return run (13*b*).

13. A device according to claim 7, wherein the belt has a width greater than its length.

14. A device according to claim 7, wherein said differential spacer means further comprise means automatically to adjust the position of the axle (16) of the roller (12) in a plane passing through the downstream end of the transport run.

15. A device according to claim 14, wherein said means (50, 131, 132) automatically to adjust the position of the axle (16) comprises a wedge (131) introduced between a bearing (29) of the roller (1) and a fixed abutment (132), and means (50) selectively to modify the position of the wedge (131) between the bearing (29) and the abutment (132).

16. A device according to claim 7, wherein at least part of said differential spacer means is controlled at least indirectly by means (52) for detecting the lateral position of the flexible endless conveyor means (13, 113) on the roller (12).

17. A transfer device for conveying fibers into a tufting machine, the transfer device (11*a*, 11*b*) comprising a roller (12) having an axle (16), flexible endless conveyor means (13, 113) having a transport run (13*a*) extending between an upstream end at which the flexible conveyor means passes about the roller (12), and a downstream end, at least one nose (14, 14*a* ), the flexible conveyor means passing about said at least one nose (14), and differential spacer means to adjust to different values a distance between the axle of the roller at different points along a width of the device and the downstream end of the transport run, said differential spacer means comprising means automatically to adjust the position of the axle (16) of the roller (12) in a plane passing through the downstream end of the transport run.

18. A device according to claim 17, wherein the means automatically to adjust the position of the axle (16) comprises a wedge (131) introduced between a bearing (29) of the roller (12) and a fixed abutment (132), and means (50) selectively to modify the position of the wedge (131) between the bearing (29) and the abutment (132).

19. A device according to claim 17, wherein at least a part of the differential spacer means is controlled at least indirectly by means (52) for detecting the lateral position of the flexible endless conveyor means (13, 113) on the roller (12).

20. A transfer device for conveying fibers into a tufting machine, the transfer device (11*a*, 11*b*) comprising a roller (12), flexible endless conveyor means (13, 113) having a transport run (13*a*) extending between an upstream end at which the flexible conveyor means passes about the roller (12) having an axle (16), and a downstream end, at least one nose (14, 14*a*), the flexible conveyor means passing about said at least one nose, and differential spacer means (23, 24, 50, 131) to adjust to different values a distance between the axle of the roller at different points along a width of the device and the downstream end of the transport run, wherein at least a part of the differential spacer means is controlled at least indirectly by means (52) for detecting the lateral position of the flexible endless conveyor means (13, 113) on the roller (12).

21. A compression and introduction device for a tufting machine, comprising two transfer devices (11*a*, 11*b*), each transfer device (11*a*, 11*b*) respectively comprising a roller (12) having an axle (16), flexible endless conveyor means (113) having a transport run (13*a*) extending between an upstream end at which the flexible conveyor means passes about the roller (12), and a downstream end, a row of noses (14*a*) aligned along said downstream end defining a width the flexible conveyor means passing about said row of noses, and differential spacer means to adjust the different values a distance between the axle of the roller at different points along the width of said transfer device and the downstream end of the transport run, said respective differential spacer means comprising stretching means to urge the noses independently of each other in a direction away from the roller, wherein the respective flexible conveyor means comprises individual drive belts (113) turning about each of the noses (14*a*), and wherein the two transfer devices (1*a*, 11*b*) are mounted with the transport runs (13*a*) of their respective flexible conveyor means facing each other.

22. A compression and introduction device for a tufting machine, comprising two transfer devices (11*a*, 11*b*), each transfer device (11*a*, 11*b*) respectively comprising a roller (12) having an axle (16), flexible endless conveyor means (13) having a transport run (13*a*) extending between an upstream end at which the flexible conveyor means passes about the roller (12), and a downstream end, a row of noses (14, 14*a*) aligned along said downstream end defining a width, the flexible conveyor means passing about said row of noses, and differential spacer means to adjust to different values a distance between the axle of the roller at different points along the width of said transfer device and the downstream end of the transport run, said respective differential spacer means comprising stretching means to urge the noses independently of each other in a direction away from the roller, wherein the respective flexible conveyor means is a belt (13) turning about the row of noses (14), and wherein the two transfer devices (11*a*, 11*b*) are mounted with the transport runs (13*a*) of their respective flexible conveyor means facing each other.

23. A device according to claim 22, wherein the respective positions of the transfer devices (11*a*, 11*b*) are adjustable in directions (D1, D2) which converge from the rollers (12) toward the noses (14, 14*a*).

24. A device according to claim 22, further comprising a V-shaped introduction slot whose internal oblique surfaces (34) are substantially adjacent to a return run (13*b*) of the flexible conveyor means (13) in the vicinity of the noses (14, 14*a*), the interior oblique surfaces (34) being connected to surfaces defining between them a tufting passage (36) in substantially prolongation of the space between the transport runs (13*a*) of the flexible conveyor means (13).

25. A compression and introduction device for a tufting machine, comprising two transfer devices (11*a*, 11*b*), each transfer device (11*a*, 11*b*) respectively comprising a roller (12) having an axle (16), flexible endless conveyor means (13, 113) having a transport run (13*a*) extending between an upstream end at which the flexible conveyor means passes about the roller (12), and a downstream end, at least one nose (14, 14*a*), the flexible conveyor means passing about said at least one nose (14), and differential spacer means to adjust to different values a distance between the axle of the roller at different points along a width of said transfer device and the downstream end of the transport run, said respective differential spacer means comprising means automatically to adjust the position of the axle (16) of the roller (12) in a plane passing through the downstream end of the transport run, wherein the two transfer devices (11*a*, 11*b*) are mounted with the transport runs (13*a*) of their respective flexible conveyor means facing each other.

26. A device according to claim 25, wherein the respective positions of the transfer devices (11*a*, 11*b*) are adjustable in directions (D1, D2) which converge from the rollers (12) toward said at least one nose (14, 14*a*).

27. A device according to claim 25, further comprising a V-shaped introduction slot whose internal oblique surfaces (34) are substantially adjacent to a return run (13*b*) of the flexible conveyor means (13, 113) in the vicinity of said at least one nose (14, 14*a*), the interior oblique surfaces (34) being connected to surfaces defining between them a tufting passage (36) in substantially prolongation of the space between the transport runs (13*a*) of the flexible conveyor means (13, 113).

28. A compression and introduction device for a tufting machine, comprising two transfer devices (11*a*, 11*b*) each transfer device (11*a*, 11*b*) respectively comprising a roller (12), flexible endless conveyor means (13, 113) having a transport run (13*a*) extending between an upstream end at which the flexible conveyor means passes about the roller (12) having an axle (16), and a downstream end, at least one nose (14, 14*a*), the flexible conveyor means passing about said at least one nose, and differential spacer means (23, 24, 50, 131) to adjust to different values at distance between the axle of the roller at different points along a width of said transfer device and the downstream end of the transport run, wherein at least a part of the respective differential spacer means is controlled at least indirectly by means (52) for detecting the lateral position of the flexible endless conveyor means (13, 113) on the roller (12), and wherein the two transfer devices (11*a*, 11*b*) are mounted with the transport runs (13*a*) of their respective flexible conveyor means facing each other.

29. A device according to claim 28, wherein the respective positions of the transfer devices (11*a*, 11*b*) are adjustable in directions (D1, D2) which converge from the rollers (12) toward said at least one nose (14, 14*a*).

30. A device according to claim 28, further comprising a V-shaped introduction slot whose internal oblique surfaces (34) are substantially adjacent to a return run (13*b*) of the flexible conveyor means (13, 113) in the vicinity of said at least one nose (14, 14*a*), the interior oblique surfaces (34) being connected to surfaces defining between them a tufting passage (36) in substantially prolongation of the space between the transport runs (13*a*) of the flexible conveyor means (13, 113).

* * * * *